US005463781A

United States Patent [19]

Jones

[11] Patent Number: 5,463,781

[45] Date of Patent: Nov. 7, 1995

[54] ANTI-SLIDE SEAT FOR BED-PATIENTS

[76] Inventor: Hedi E. Jones, 2243 Westwood Ct., Pittsburg, Calif. 94565

[21] Appl. No.: 399,133

[22] Filed: Mar. 6, 1995

[51] Int. Cl.[6] ..... A47C 21/00; A47C 27/00

[52] U.S. Cl. ..... 5/630; 5/653; 5/922; 297/217.1

[58] Field of Search ..... 5/630–633, 636, 5/640, 922, 653, 654, 448, 490; 297/217.1

[56] References Cited

U.S. PATENT DOCUMENTS

| | | | |
|---|---|---|---|
| 972,712 | 10/1910 | Palmer | 5/632 |
| 2,785,419 | 3/1957 | Walker | 5/630 |
| 3,465,367 | 9/1969 | Emery | 5/630 |
| 4,127,120 | 11/1978 | Applegate | 5/922 |

*Primary Examiner*—Alexander Grosz

[57] ABSTRACT

An anti-slide seat for bed patients, consisting of a ring-shaped, cushioned seat, secured by means of canvas belts to a pair of adjustable metal hooks which fit over the top of the mattress. Velcro-closing lap belts help secure the patient in place. Pressure on the patient's bottom is minimized, which helps to prevent bed sores.

4 Claims, 2 Drawing Sheets

ANTI-SLIDE SEAT FOR BED-PATIENTS

BACKGROUND OF THE INVENTION

1. Field of the Invention

The invention relates generally to a ring-shaped seat or cushion to be used by a bed-ridden patient, which can be attached to the top of the mattress by means of canvas belts and metal hooks so as to make it impossible for the patient to slide down in bed.

2. Description of the Prior Art

Patients who have to spend long days in bed usually prefer a propped up or sitting up position. The problem with this is that, after a while, they tend to slide down in bed. If they are unable to heave themselves up, they need to be pulled up and re-positioned by their attendants. Patients tend to get sore bottoms from this. But no matter how well they are supported, either with pillows or by elevating the head of the bed, this does not prevent them from sliding down. Sliding will occur both with a flat mattress and an elevated one. This invention will solve the problem of the downward slide in any position and help minimize bedsores.

SUMMARY OF THE INVENTION

The invention consists of a ring-shaped, cushioned seat showing loops on it's upper sides through each of which a metal ring is fastened. The rings are attached by means of canvas belts to the proximal ends of two metal rods which lie flat on the mattress behind and on either side of the patient. Their distal ends fit around the top of the mattress by two right angles, forming essentialy squared off hooks. The hooks are adjustable to fit various mattress thicknesses. The belts which serve to attach the seat to the hooks show adjustable closing means to allow them to be lengthened or shortened easily. Optional lap belts can be added to the metal rings to secure an unstable patient in the sitting up position. When using this seat, the patient's coccyx will not touch the bed, preserving skin integrity and eliminating bedsores.

DESCRIPTION OF THE PREFERRED EMBODIMENT

Figure 1:
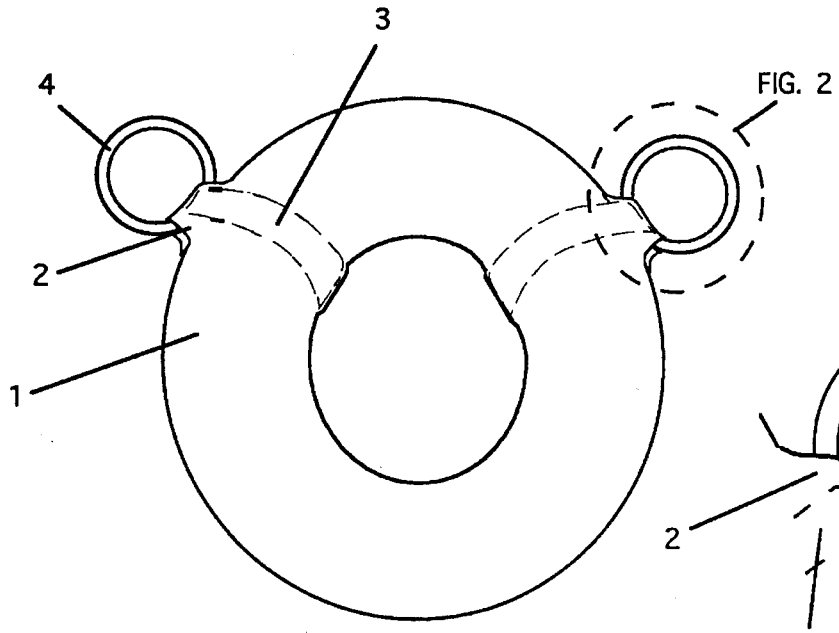
FIG. 1 is a view of the ring-shaped, upholstered seat for use in bed, having a metal ring on each upper side.

Referring to FIG. 1, an embodiment of the invention is shown. A ring-shaped seat 1 is provided which is cushioned or upholstered for the patient's comfort. It may be covered in fabric or vinyl for easy care. On both upper sides of the seat 1 the covering fabric extends into a loop 2 through which a metal ring 4 is threaded. The rings 4 are provided as attaching means to anchor the seat 1 in place. Since there will be considerable pull on the rings 4, straps 3 are provided which run around the thickness of the seat 1 and through the rings 4, forming part of the loop 2, but under the covering fabric of the seat 1 so as not to cause the user any discomfort.

Figure 2:
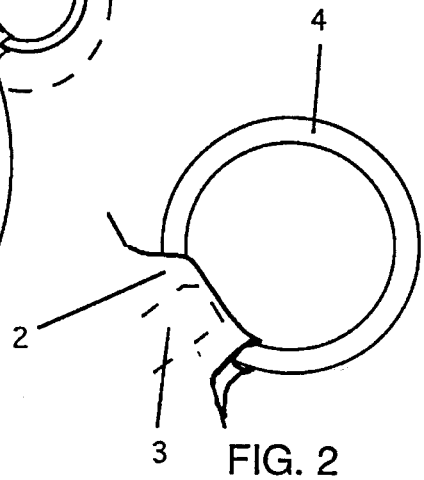
FIG. 2 is an enlargement of part of FIG. 1, showing in detail attachment means for the ring.

Referring to FIG. 2, an enlargement of the seat attaching means is shown. The loop 2 is formed by the covering fabric of the seat 1 and is re-inforced by a sturdy strap 3 underneath it. A metal ring 4 is threaded through both loop 2 and underlying strap 3 forming attaching means for anchoring the seat 1.

Figure 3:
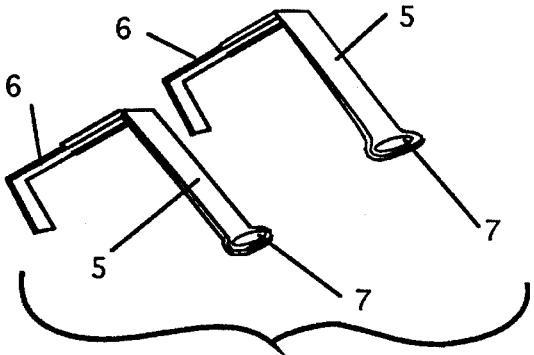
FIG. 3 is a view of the metal hooks which fit around the mattress, showing an extension member.

Referring to FIG. 3, two flat metal rods 5 are shown. Their distal ends are in the shape of hooks, having squared off corners in order to make them fit over the head of a mattress. The hooks 5 are provided with extension members 6 which can be pulled out or pushed in, to accommodate different sizes of mattresses. The proximal ends of the hooks 5 are fitted with integral loops or eyes 7 which provide attaching means for belts.

Figure 4:
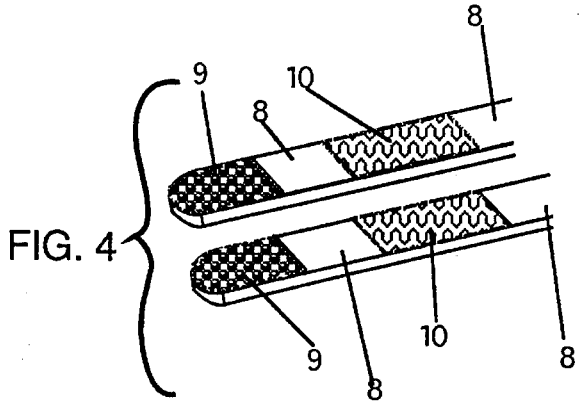
FIG. 4 is a view of the canvas belts which attach to the metal hooks and seat rings, showing at the end hook and loop closing means.

Referring to FIG. 4, two belts 8 made of canvas or any other strong material are shown. The belts 8 have hook 9 and loop 10 closing means on both ends so that they can be closed against themselves after being threaded through the attaching means.

Figure 5:
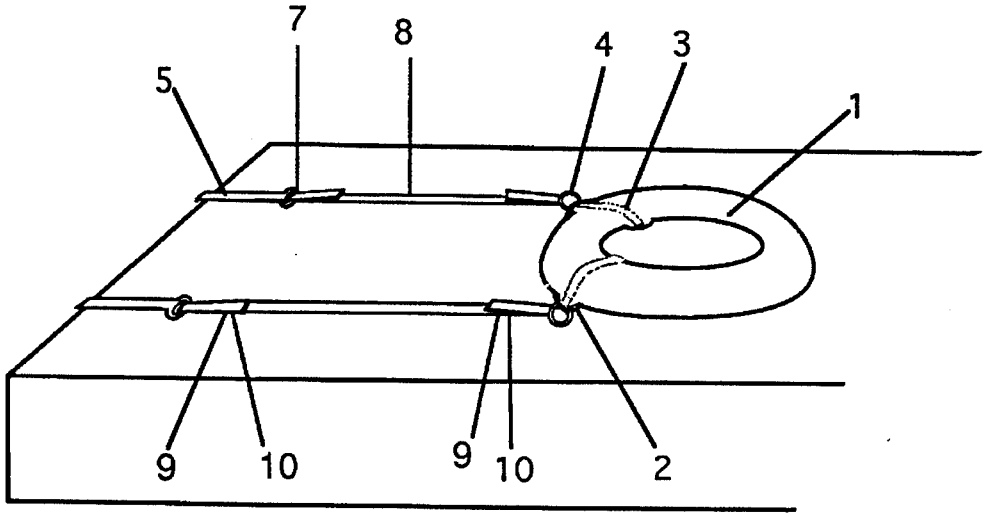
FIG. 5 is a view of the seat with attachments in use on a flat mattress.

Referring to FIG. 5, the seat 1 is shown in use and attached to a mattress by means of the metal hooks 5 and canvas belts 8. The belts 8 are threaded through the loops 7 on the metal hooks 5 and their other end through the rings 4 on either side of the seat 1. The weight of a patient sitting or lying on the seat 1 can now no longer make the seat 1 slide downwards.

Figure 6:
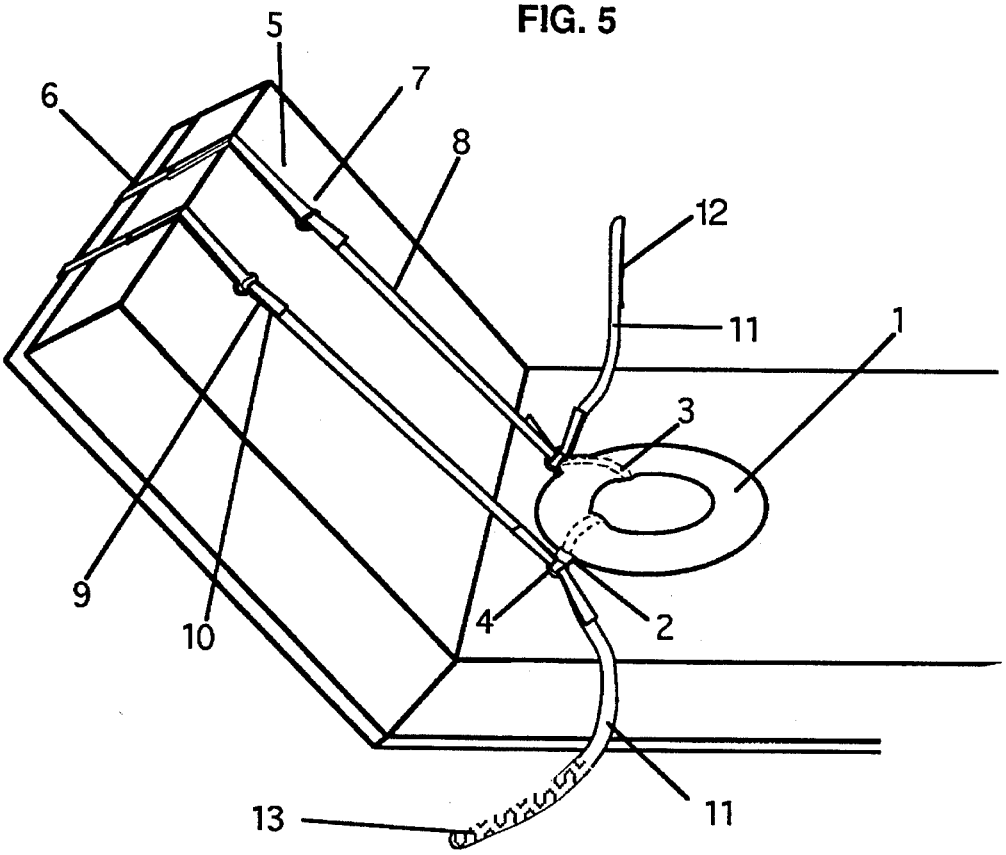
FIG. 6 is a view of the seat in use on an elevated mattress, showing the optional lap belts.

Referring to FIG. 6, the seat 1 is again shown in use on a bed. The head of the bed has been elevated to give support to the patient. Once seated on the seat 1, the patient will not slide down, as the seat 1 is secured by belts 8 to the metal hooks 5 which can fit by means of their extensions 6 over both mattress and bed frame. The patient can be further secured by lap belts 11 which attach to the rings 4 on either side of the seat 1 by hook and loop type fasteners or closing, such as the ones sold under the trademark of Velcro. The lap belts 11 are provided with hook and loop closing means 12 and 13. The patient can now be further supported with pillows placed on top of the belts 8 and the lap belts 11 will hold him comfortably in place.

Although an embodiment of the invention is illustrated in the drawings and previously described in detail, this invention encompasses any design and relationship of components which will function in a similar manner and which will provide the equivalent results.

I claim:

1. An anti-slide seat for bed patients comprising:

(a) a seat, having a covering material made in the shape of a ring and being cushioned or upholstered in a soft material;

(b) two straps running around the thickness of the seat on either side, but under the covering material, emerging at the outer periphery and forming with the covering material a loop;

(c) two unbreakable rings threaded through the loops;

(d) two squared-off metal hooks of a size to fit over the head of a mattress, their lower ends forming an opening in the shape of an oval slot;

(e) a pair of strong belts having hook and loop closing means on both ends, each of said belts adapted to be connected between an unbreakable ring and an opening in the shape of an oval slot; and (f) lap belts attached to the rings on the seat by means of hook and loop closing.

2. An anti-slide seat as recited in claim 1, in which the squared-off hooks have an extension member by which their width can be changed to accommodate various sized mattresses.

3. An anti-slide seat as recited in claim 2, in which one end of the belts can be threaded through the oval slots on the hooks and the other end through the rings on the seat and secured by adjustable closing means varying the position of the seat.

4. An anti-slide seat as recited in claim 3, in which the lap belts fasten around the patient with an adjustable closure and are strong and broad enough to hold the patient securely in place.

* * * * *